US006109671A

United States Patent [19]

Roncin et al.

[11] Patent Number: 6,109,671

[45] Date of Patent: Aug. 29, 2000

[54] ELECTRIC LOCK FOR A MOTOR VEHICLE OPENING LEAF

[75] Inventors: Jean-Michel Roncin, Abbeville; Yves Duboille, Buigny Saint Maclou, both of France

[73] Assignee: Valeo Securite Habitacle, Creteil, France

[21] Appl. No.: 09/366,550

[22] Filed: Aug. 4, 1999

[30] Foreign Application Priority Data

Aug. 5, 1998 [FR] France ..... 98 10057

[51] Int. Cl.[7] ..... E05C 3/06

[52] U.S. Cl. ..... 292/216; 292/DIG. 43; 292/201

[58] Field of Search ..... 292/201, 516, 292/DIG. 43, DIG. 23, DIG. 65

[56] References Cited

U.S. PATENT DOCUMENTS

| | | | |
|---|---|---|---|
| 4,395,064 | 7/1983 | Bellot | 292/201 |
| 4,948,184 | 8/1990 | Weyerstall | 292/216 |
| 5,074,603 | 12/1991 | Brackmann | 292/216 |
| 5,613,716 | 3/1997 | Cafferty | 292/216 |
| 5,769,468 | 6/1998 | Armbruster | 292/201 |
| 5,897,148 | 4/1999 | Arabia | 292/216 |
| 5,979,951 | 11/1999 | Shimura | 292/216 |

FOREIGN PATENT DOCUMENTS

| | | |
|---|---|---|
| 0 808 977 | 11/1997 | European Pat. Off. . |
| 0 812 972 | 12/1997 | European Pat. Off. . |
| 195 05 779 | 8/1996 | Germany . |
| 196 14 122 | 10/1997 | Germany . |
| 297 01 390 U | 10/1997 | Germany . |
| 196 17 428 | 11/1997 | Germany . |
| 2 309 482 | 7/1997 | United Kingdom . |

*Primary Examiner*—B. Dayoan
*Assistant Examiner*—Gary Estremsky
*Attorney, Agent, or Firm*—Pollock, Vande Sande & Amernick

[57] ABSTRACT

Electric lock comprising a driver (132) secured to a pawl (131) and comprising a V-shaped recess (134), an electric motor intended to drive a wrist pin capable of entering said recess until the driver escapes the action of the wrist pin, an immobilizing means (140, 141) capable of adopting a position for immobilizing the pawl at the end of the pivoting of the pawl toward its separated position, and of adopting a position for releasing the pawl, preferably at the end of the rotational travel of the latch toward its unlocked position at the latest, characterized in that the immobilizing means comprises a moving catching member (140) with elastic return and a mating retaining projection (141), one of these borne by the driver (132) and the other by the latch (130), said member being capable of overcoming and then catch onto said projection and further on at the end of the pivoting of the pawl, the pawl thus being immobilized in the separated position until the latch begins to pivot toward its unlocked position.

20 Claims, 3 Drawing Sheets

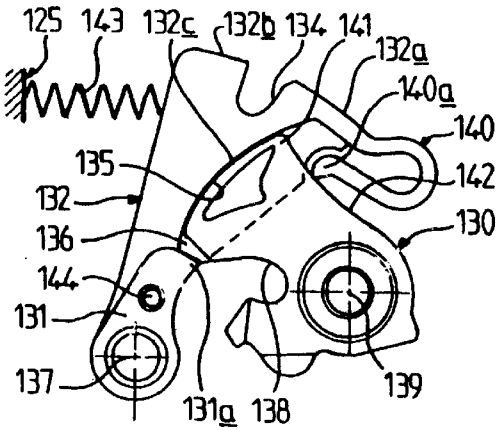
FIG. 1
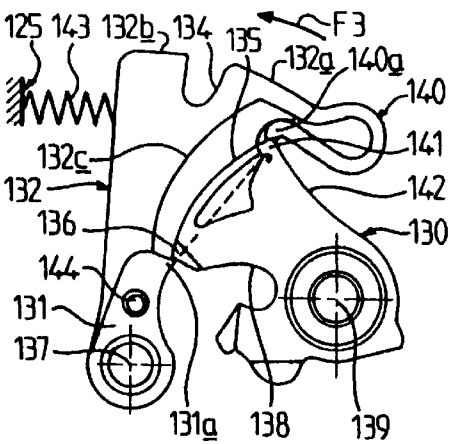
FIG. 2
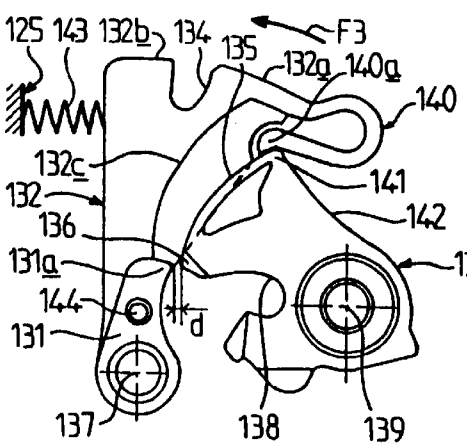
FIG. 3
FIG. 4
FIG. 5
FIG. 6

ELECTRIC LOCK FOR A MOTOR VEHICLE OPENING LEAF

The invention relates to an improved electric lock for an opening leaf of a motor vehicle, particularly for a door, a tailgate or a tailgate window of a motor vehicle.

An electric lock of this type is already known from European Patent Application No. 812 972, a diagrammatic overall view of which is depicted in appended FIG. 14. In this FIG. 14, the reference 25 has been used to denote the lock casing overall. The lock comprises, inside the casing 25, an electric motor 9, on the shaft of which is fixed a pinion 9*a* which meshes with a gear 9*b* of a set of gears 26, the output pinion 9*c* of which cooperates with a gear wheel 27 which constitutes the rotary element controlling the operation of the lock. The rotary element 27 is a disk which bears two diametrically opposed wrist pins 28, 29, these wrist pins facing a driver 32. The end of the driver 32 which cooperates with the wrist pins 28 and 29 is in the shape of a boot, the sole part of which has been denoted by 32*a* and the heel part of which has been denoted by 32*b;* between these two parts is a substantially V-shaped recess 34; the opposite end of the driver 32 to the parts 32*a,* 32*b* is connected to a pivot axle 37, the driver 32 being capable of a pivoting movement about said axle 37. The lock comprises a forked latch 30, the fork of which delimits a housing 38 which is intended to receive a striker 4 which cooperates with the lock. In the known way, the striker 4 is a stub which projects from the door post facing the lock, the relative movement of the door with respect to the door post, in the direction for closing the door, corresponding to a relative movement of the striker in the direction of arrow F1 and, in the direction for opening the door, to a relative movement of the striker 4 in the direction of arrow F2. The latch 30 is capable of pivoting about an axle 39 and it cooperates with a pawl 31 which is capable of pivoting about the axle 37 and rotates as one with the driver 32. The pawl 31 is subject to an elastic return force which pushes it toward the latch 30.

In the door locked position depicted in FIG. 14, the pawl 31 comes to bear via its end nose 31*a* against a notch 36 defined on the latch 30. Thus the striker 4 is trapped in the recess 38, and this keeps the door locked.

If the motor 9 is powered, the rotary element 27 is made to rotate and the wrist pin 29 enters the V-shaped recess 34 of the driver 32, because of the position of rest that said driver occupied at the time the lock was locked. As this rotation continues, the wrist pin 29 comes into contact with the heel part 32*b* of the free end of the driver 32 and from this point on, any subsequent rotation of the disk 27 causes the driver 32 to pivot about the axle 37. As the pawl 31 and the driver 32 rotate as one, the pawl 31 pivots in the clockwise direction until the nose 31*a* of the pawl 31 is allowed to escape from the notch 36 of the latch 30.

In normal use, as soon as the latch 30 is no longer retained by the pawl 31, the latch 30 pivots to release the striker 4 which moves in the direction of arrow F2. The pivoting of the latch 30 is brought about by the reaction force of the elastic seal inserted between the door and the door post of the vehicle. The mouth of the lock housing 25, through which the striker 4 moves, has been labeled 25*a*.

However, if the reaction force of the door seal is canceled for any reason, the striker 4 no longer exerts a pulling force on the latch 30, and this means that the latch remains in the position illustrated in FIG. 14. In such a case, as the disk 27 continues to rotate, the heel part 32*b* of the driver 32 escapes from the wrist pin 29, and this causes the driver 32 and therefore the pawl 31 to return to its starting position in which the nose 31*a* engages on the notch 36 of the latch 30. As a result, subsequent rotation of the disk 27 causes the opposite wrist pin 28 to engage in turn in the recess 34, and this once more causes the driver 32 to pivot, and so on, until the motor 9 stops its rotational drive.

This scenario may occur particularly on a vehicle trunk tailgate, when a heavy snow fall is covering the tailgate, the weight of the snow compensating for the reaction force of the tailgate seal.

In this case, the alternating pivoting of the driver 32, as long as the electric motor 29 is driving the disk 27, causes the pawl 31 to beat against the latch 30 repetitively each time a wrist pin escapes the driver. This causes an audible "machine-gun" effect which the user finds most unpleasant. Furthermore, as the latch 30 does not move, the pawl 31 will have returned to its initial position when the motor 9 stops its rotational drive, and this means that the opening leaf will remain locked.

The object of the invention is to provide an electric lock of the aforementioned type but which makes it possible to eliminate the audible nuisance constituted by the possible alternating pivoting of the driver and which allows the lock to be unlocked even when the door seal does not produce a reaction force of the striker on the latch.

To this end, the subject of the invention is an electric lock for an opening leaf of a motor vehicle, said lock comprising:

a pivoting fork-shaped latch intended to cooperate with a striker secured to the vehicle bodywork, a pawl pivoting on a fixed axle and subject to elastic return which urges it toward the latch, said pawl being designed to cooperate with at least one notch of the latch to prevent rotation of said latch and thus keep the striker captive in the fork of the latch when the opening leaf is in the locked position, said pawl being capable of moving away from the latch to allow the latch to rotate, releasing the striker, when the opening leaf is brought into the unlocked position, a driver secured to the pawl, pivoting about the same fixed axle, and comprising a substantially V-shaped recess, an electric motor intended to drive a rotary element bearing at least one wrist pin, said wrist pin being capable of entering said V-shaped recess to cause the driver and therefore the pawl to pivot in the opposite direction to the elastic return, the rotary element continuing its rotation at least until the driver escapes the action of the wrist pin, and being associated with a means of stopping the motor which stops the motor from rotating after the driver has escaped the action of the wrist pin, an immobilizing means for immobilizing the pawl in its separated position, allowing the latch to rotate, said immobilizing means being capable of adopting a first active position for immobilizing the pawl substantially at the end of the pivoting of the pawl toward its separated position, and of remaining in this active immobilizing position at least until the latch pivots with a view to releasing the striker, said immobilizing means being capable of adopting a second position for releasing the pawl, preferably at the end of the rotational travel of the latch toward its lock unlocked position at the latest, characterized in that the immobilizing means comprises a moving catching member with elastic return and a mating retaining projection, one of these borne by the driver and the other by the latch, said catching member being capable of moving against the effect of its elastic return to overcome and then catch onto said retaining projection further on at the end of the pivoting of the pawl, the pawl thus being immobilized in the separated position by the latch by means of said catching member, until the latch begins to pivot toward its lock unlocked position, the pivoting of the latch causing the catching member to disengage from the retaining projection.

Advantageously, the wrist pin of the rotary element and the V-shaped recess of the driver are arranged with respect to each other in such a way that when the wrist pin enters the recess it causes the driver to pivot through an unlocking travel which causes the pawl to separate from the latch until the pawl escapes the notch of the latch, then the wrist pin causes the driver to pivot through an additional travel before escaping the V-shaped recess, said additional travel making it possible to generate clearance between the latch and the pawl, which clearance is maintained by the aforementioned immobilizing means at the latest until it has left its active immobilizing position. Thus, an important characteristic of the invention is that it amplifies the clearance between the latch and the pawl, by virtue of the additional travel of the driver.

In this case, it may be arranged that the immobilizing means adopts its second position of releasing the pawl as soon as the latch turns with a view to releasing the striker, the pawl pivoting through a distance corresponding to the aforementioned clearance as it passes from the first, active, position into said second position. Thus, when the latch pivots once more into its lock locked position, the immobilizing means will no longer immobilize the pawl, and this will avoid leaving the pawl in the separated position and will thus allow the pawl to engage on the notch in the latch in order to keep the door locked.

According to another characteristic of the invention, when the immobilizing means is in its second position—that of releasing the pawl, the catching member is upstream of the retaining projection so that as the latch returns to the locked position, the retaining projection pushes the catching member back toward its position of rest, in the direction of the elastic return force of the pawl, which contributes to returning the pawl to the position of rest in order to lock the lock.

In an alternative form, the catching member is an elastically deformable tab. As a preference, the elastically deformable tab is in the shape of a hairpin bent into a U, one end of which is secured to the driver, and the other free end of which is capable of catching on the retaining projection formed on the latch.

In another alternative form, the catching member is a moving retractable peg subject to the elastic force of a return spring. As a preference, the moving peg is mounted so that it can retract linearly on the latch, the free end of the peg being capable of catching on said retaining projection formed on the driver.

According to yet another characteristic, the retaining projection is extended upstream by a guide ramp against which the catching member bears as the pawl pivots before reaching the active immobilizing position, this making it easier for the catching member to overcome the retaining projection, said guide ramp being inclined in such a way as to generate on the pawl a force which tends to make the pawl pivot in the direction of the elastic return force, as the latch returns to its lock locked position.

In another alternative form, the moving part is an elastically deformable tab secured at one point to the lock casing and replacing, in functional terms, the tilting lever and its return spring which were mentioned hereinabove.

In a way known per se, the driver is a lever which, in plan view, has the shape of a boot, the aforementioned recess corresponding to the hollow there is between the sole part and the heel part of the boot, the articulation about which said lever pivots being at its opposite end to the end bearing the parts of the boot.

In the first alternative form of the first aforementioned embodiment, the elastically deformable tab is secured to the driver substantially at the tip of the sole part of the boot.

In the second alternative form of the first embodiment, the retaining projection is formed on the boot on the opposite face to the sole.

In a way which is also known per se, the rotary element is driven by a motor which has just one direction of rotation and bears two wrist pins arranged symmetrically with respect to its axis, the means of stopping the motor consisting, firstly, of that one of its wrist pins which has not, during the lock unlocking operation just performed, caused the driver to pivot coming mechanically into abutment against the sole part of the driver and, secondly, of the cutting of the power supply to the motor, which does not occur until after the wrist pin has come mechanically into abutment against the driver.

In this case, when the lock is in the unlocked position, the pawl bears against an edging of the latch and, when the lock reaches the locked position, the pawl coming to cooperate with a notch in the latch under the action of its elastic return, the driver and the pawl pivot through an angle that is large enough for the wrist pin which was in line with the sole part of the driver to come into line with the recess.

Other characteristics, known per se from European Patent Application No. 812 972, may also be combined with the present invention, namely the fact that:

when the lock is in the locked position, an edging of the driver rests against the edging of the latch, the shape of the sole part of the driver and the form of its connection to the region where the pivot axle of said driver is located gives said sole part elasticity which gives the wrist pin which comes to bear against said part a small amount of rebound, the heel part of the driver, at the instant of said bearing, lying in line with the other wrist pin in order to restrict the rebound, the cutting of the power supply to the motor is due to a time delay.

In order to provide a better understanding of the object of the invention, a number of embodiments depicted in the appended drawing will now be described by way of purely illustrative and nonlimiting examples.

In this drawing:

FIG. 1 is a diagrammatic view depicting, in plan, for a first embodiment of the lock of the invention, the driver, the pawl, the latch and the immobilizing means in the locked position of said lock;

FIG. 2 is a view similar to FIG. 1, as the driver is pivoted with a view to unlocking the lock;

FIG. 3 is a view similar to FIG. 2, depicting the pawl in its position held separated by the immobilizing means, at the end of the pivoting of the driver;

FIG. 4 is a view similar to FIG. 3 after the latch has rotated into the lock unlocked position;

FIG. 5 is a view similar to FIG. 4, as the latch is rotated into its lock locked position;

FIG. 6 is a view similar to FIG. 5, substantially at the end of the rotational travel of the latch into its locking position;

FIGS. 1 to 6 depict a first embodiment of the lock of the invention in the various positions that correspond to the various kinematic phases in the unlocking and locking of the lock. The elements of this first embodiment which are identical or similar to the elements to the known lock illustrated in FIG. 14 bear the same reference numerals increased by one hundred.

Figure 7:
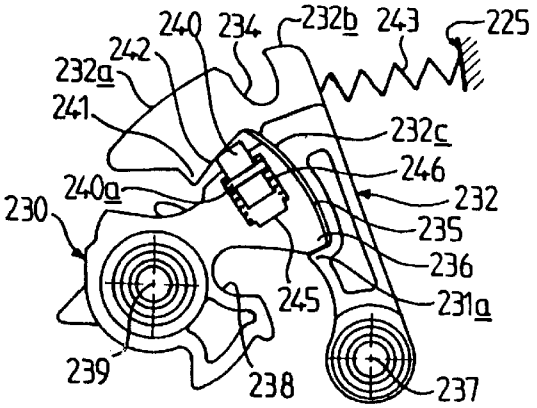
FIGS. 7 to 12 depict an alternative form of the lock of the invention and correspond respectively to FIGS. 1 to 6.

In this first embodiment, the boot-shaped driver 132 has, at the tip of its sole part 132*a*, a catching tab bent substantially into a hairpin shape 140, the free end 140*a* of which faces toward the curved edging 132*c* of the upper of the boot of the driver 132. This tab 140 is molded integrally with the boot 132 and is elastically deformable, as explained later on.

The forked latch 130 has, on one of the branches of its fork, a convex edging 135 which is intended to bear against the corresponding concave edging 132*c* of the driver 132 in the position of rest illustrated in FIG. 1, which corresponds to the lock locked position. The convex edging 135 of the latch 130 has, at its opposite end to the recess 138, a projecting retaining portion 141 which is intended to cooperate with the free end 140*a* of the elastic catching tab 140, as explained later on. The projecting portion 141 is extended by a guide ramp 142 against which the end 140*a* of the tab 140 comes to bear.

There is a compression spring 143 between the lock casing 125 and the driver 132, in order to urge the latter toward the latch 130. The pawl 131 rotates as one with the driver 132 about the axle 137, for example by virtue of a connecting pin 144.

The way in which this first embodiment of the lock of the invention operates will now be described with reference to FIGS. 1 to 6.

Figure 14:
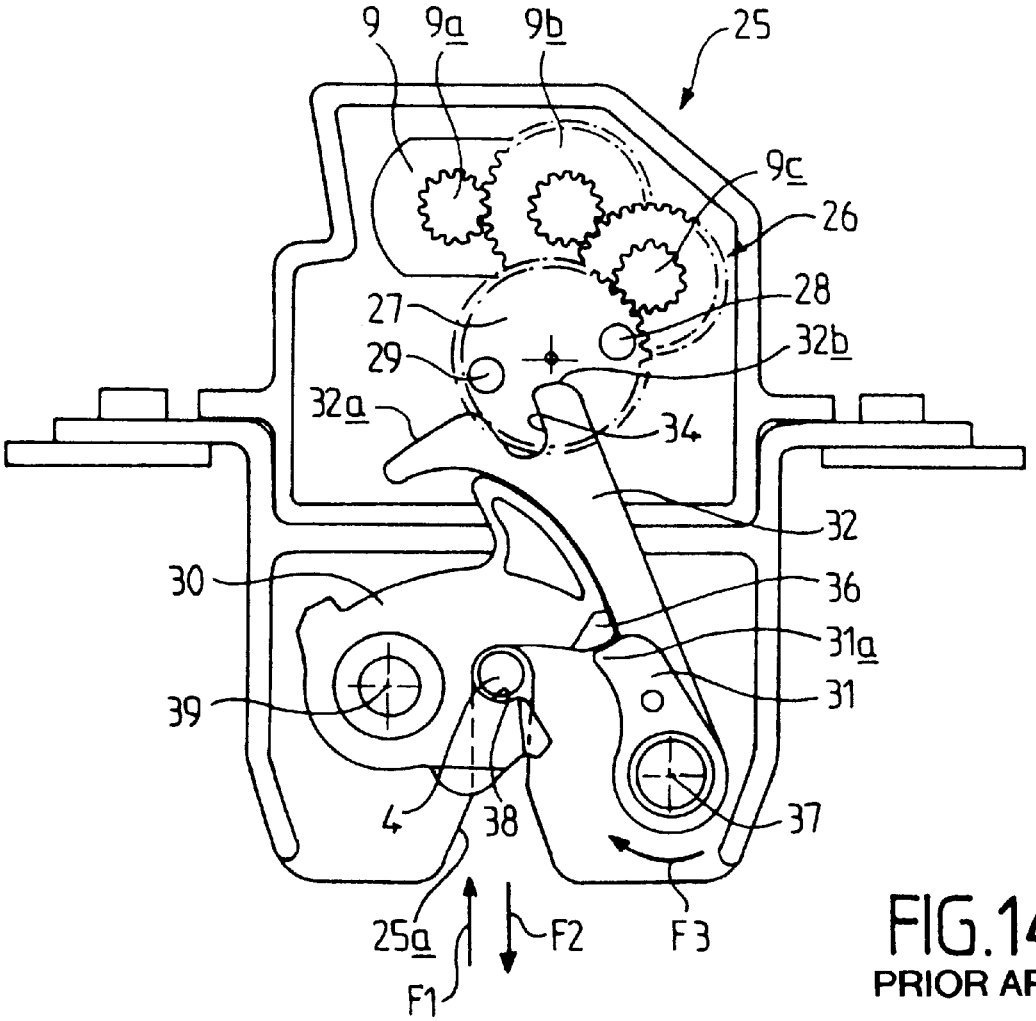
FIG.14 PRIOR ART
FIG. 14 depicts diagrammatically in plan an overall view of a known lock in the locked position.

Starting from the lock locked position illustrated in FIG. 1, if the motor 9 of FIG. 14 is powered, the rotary element 27 is rotated and the wrist pin 29 engages in the V-shaped recess 134 of the driver 132 and comes into contact with the heel part 132*b* of the free end of the driver 132, and this causes the driver 132 to pivot about the axle 137 in the direction of arrow F3 in FIG. 2. During this pivoting of the driver 132 in the direction of arrow F3, the free end 140*a* of the elastic tab 140 slides along the ramp 142 of the latch 130 which is held immobile by the pawl 131, and the elastic tab deforms, slightly closing the opening of the U. FIG. 2 depicts an unstable intermediate position in which the nose 131*a* of the pawl 131 is just about to escape from the notch 136 in the latch 130, and the free end 140*a* of the tab 140 is just about to overcome the retaining projection 141 of the latch 130.

As the driver 132 continues to rotate in the direction of arrow F3, the nose 131*a* of the pawl 131 becomes separated by a clearance d from the notch 136 of the latch 130 and the free end 140*a* of the tab 140 catches on the projection 141 of the latch 130. FIG. 3 depicts the end-of-pivoting position of the driver 132 in the direction of arrow F3, because in this position, the wrist pin 29 has escaped from the V-shaped recess 134 of the driver 132. Assuming that no reaction force is exerted on the latch 130 by the striker 4, the latch 130 remains in the position illustrated in FIG. 3, but the pawl 131 remains in its separated position, in spite of the elastic return force of the spring 143, because the free end 140*a* of the tab 140 is caught on the retaining projection 141 of the latch 130.

If the disk 27 continues to rotate, the opposite wrist pin 28 will come into abutment against the sole part 132*a* of the driver 132, and this will thus avoid the "machine-gun" noise and the return of the pawl 131 to the locked position. The motor 9 will thus be immobilized, in spite of the fact that its electrical power supply is maintained until the end of a time delay.

If a reaction force is exerted on the latch 130 by the striker 4, either because of the compressive force in the door seal or because of an opening force exerted by the user on the door, the latch 130 will pivot in the direction of arrow F2 of FIG. 4, to release the striker 4. The rotation of the latch 130 about its axle 139 has the effect of disengaging the elastic tab 140 from the retaining projection 141, and this releases the driver 132 from the latch 130. As the driver 132 has been released, it pivots in the direction of arrow F4, the opposite direction to arrow F3, under the action of the spring 143 over a distance that corresponds to the aforementioned clearance d because the pawl 131 is kept against the latch 130 because its nose 131*a* is bearing against the edging 135, and this continues to be the case throughout the rotational travel of the latch 130 toward its lock unlocked position.

When the door once more returns to the closed position, starting from the position of FIG. 4, the latch 130 moves in the direction of arrow F1, which is the opposite direction to arrow F2, as illustrated in FIG. 5. In the intermediate position illustrated in FIG. 5, it may be seen that the free end 140*a* of the catching tab 140 is now on the other side of the retaining projection 141, that is to say is upstream of it, because between the positions illustrated in FIGS. 3 and 5 the driver 132 has moved through a distance corresponding to the clearance d.

Thus, when the latch 130 finishes rotating toward the locked position, between FIGS. 5 and 6, it will elastically deform the tab 140 and as soon as the notch 136 of the latch 130 comes beyond the nose 131*a* of the pawl 131, the pawl 131 pivots under the effect of the return spring 143 into the position illustrated in FIG. 1, and this returns the various parts of the lock to their starting position of rest.

Added to the elastic return force exerted by the spring 143 on the driver 132 between the positions of FIGS. 6 and 1, is the elastic return exerted by the tab 140 which was earlier deformed by the latch 130.

Reference will now be made to FIGS. 7 to 12 which depict an alternative form of the lock of the invention, the various members of which bear the same reference numerals as the members of the first embodiment, increased by one hundred.

In the alternative form illustrated in FIGS. 7 to 12, the pawl is as one with the driver 232, and this makes it possible to dispense with the connecting pin 144 for rotation that was found in the first embodiment.

The latch 230 comprises a housing 245 in which there is mounted so that it can move linearly a moving peg 140 which is held at least partially in the housing 245 by a flange 240*a*. A compression spring 246 is mounted in the housing 245 and bears at one end against the bottom of this housing and at its opposite end against the aforementioned flange 240*a* to urge the peg 240 to project outside the external contour of the latch 230. The moving peg 240 emerges from the opposite face of the latch 230 to the housing 238, with respect to the curved edge 235 facing the sole part 232*a* of the boot 232.

The moving peg 240 is intended to come to bear against a guide ramp 242 formed on the opposite surface of the boot 232 to the sole, which guide ramp 242 is extended by a retaining projection 241 which is intended to cooperate with the moving peg 240, as explained later on.

Figure 8:
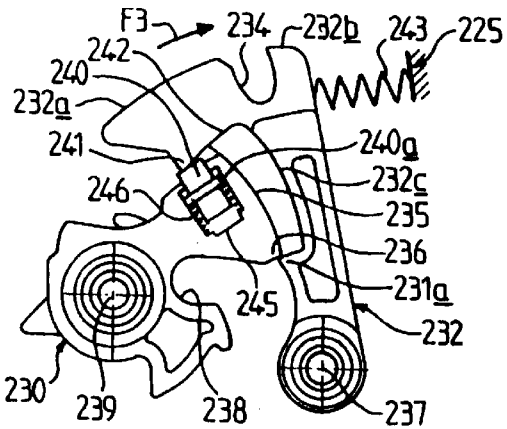
Figure 9:
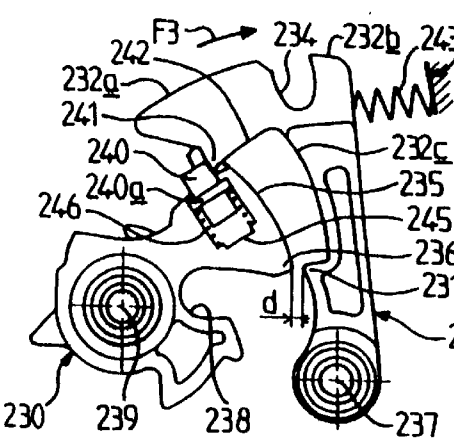
Figure 10:
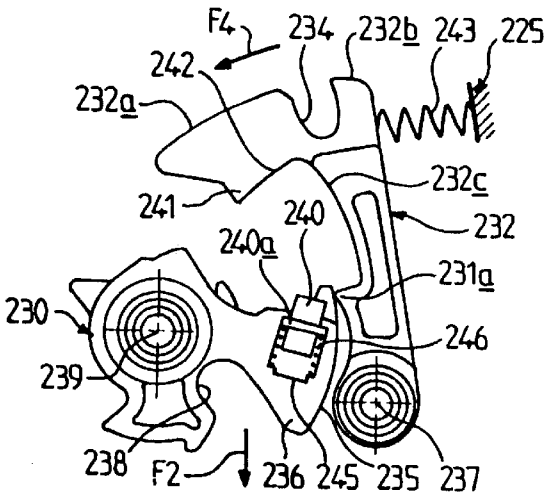
Figure 11:
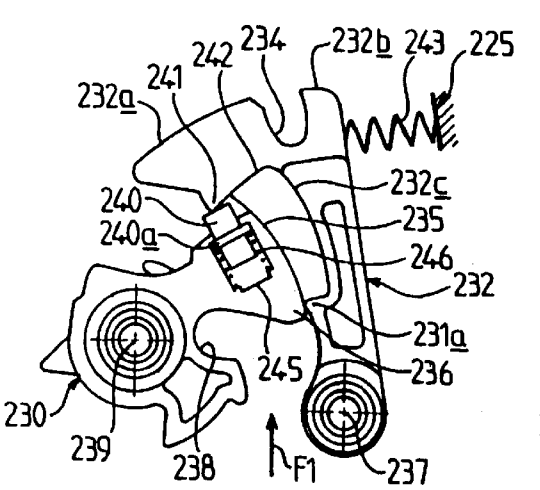
Figure 12:
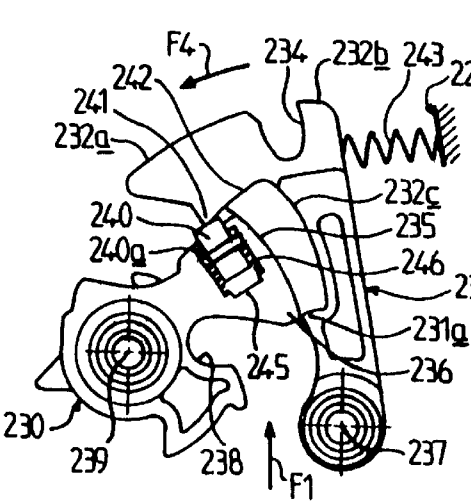

Starting from the lock locked position illustrated in FIG. 7, when the motor 9 causes the driver 232 to pivot in the direction of arrow F3, as illustrated in FIG. 8, the moving peg 240 slides along the ramp 242 of the boot 232, and this causes the moving peg 242 to retract slightly into its housing 245. Then, at the end of the pivoting of the driver 232, as illustrated in FIG. 9, the moving peg 240 overcomes the projecting portion 241 of the boot 232, and this causes the moving peg 240 to relax and thus immobilize the boot 232 against any subsequent rotation in an opposite direction to arrow F3. It will thus be understood that the moving peg 240 with its compression spring 246 corresponds, in functional terms, to the elastically deformable tab 140 of the first embodiment. This being the case, the alternative form illustrated in FIGS. 7 to 12 will not be described further in detail.

Figure 13:
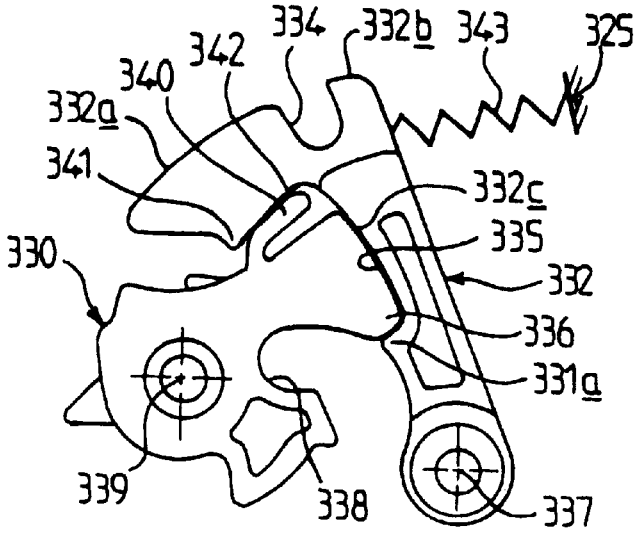
FIG. 13 is a view similar to FIG. 7 but depicts another alternative form of the lock of the invention.

FIG. 13 depicts another alternative form, in which the elements which are identical or similar to the elements of FIG. 7 have been denoted by the same reference numerals increased by one hundred.

In comparison with the embodiment illustrated in FIG. 7, the alternative form of FIG. 13 differs simply by the fact that the moving peg 240 and its spring 246 have been replaced, in functional terms, by an elastically deformable tab 340 which cooperates with the guide ramp 342 and the projecting retaining portion 341 of the boot 332.

Although this has not been depicted, it will be readily understood that instead of the elastically deformable tab 140 of the first embodiment illustrated in FIGS. 1 to 6, it would be possible to provide a moving peg similar to the peg 240 of FIG. 7 on the boot-shaped driver, without departing from the scope of the invention.

Although the invention has been described in conjunction with a number of particular embodiments, it is quite clear that it is not in any way restricted thereto and that it comprises all the technical equivalents of the means described, together with their combinations, if these fall within the scope of the invention.

What is claimed is:

1. Electric lock for an opening leaf of a motor vehicle, said lock comprising:

a pivoting fork-shaped latch (130, 230, 330) intended to cooperate with a striker (4) secured to the vehicle bodywork, a pawl **(131, 231*a*, 331*a*) pivoting on a fixed axle (137, 237, 337) and subject to elastic return (143, 243, 343) which urges it toward the latch, said pawl being designed to cooperate with at least one notch (136, 236, 336) of the latch to prevent rotation of said latch and thus keep the striker captive in the fork of the latch when the opening leaf is in the locked position, said pawl being capable of moving away from the latch to allow the latch to rotate, releasing the striker, when the opening leaf is brought into the unlocked position, a driver (132, 232, 332) secured to the pawl, pivoting about the same fixed axle, and comprising a substantially V-shaped recess (134, 234, 334), an electric motor (9) connected for driving a rotary element (27) having at least one wrist pin (28, 29), said wrist pin being capable of entering said V-shaped recess to cause the driver and therefore the pawl to pivot in the opposite direction to the elastic return, the rotary element continuing its rotation at least until the driver escapes the action of the wrist pin, and being associated with a means of stopping the motor which stops the motor from rotating after the driver has escaped the action of the wrist pin, an immobilizing means (140, 141; 240, 241; 340, 341) for immobilizing the pawl in its separated position, allowing the latch to rotate, said immobilizing means being capable of adopting a first active position for immobilizing the pawl substantially at the end of the pivoting of the pawl toward its separated position, and of remaining in this active immobilizing position at least until the latch pivots to a postion for releasing the striker, said immobilizing means being capable of adopting a second position for releasing the pawl, preferably at the end of the rotational travel of the latch toward its lock unlocked position at the latest, characterized in that the immobilizing means comprises a moving catching member (140, 240, 340) with elastic return and a mating retaining projection (141, 241, 341), one of these borne by the driver (132, 232, 332) and the other by the latch (130, 230, 330)** , said catching member being capable of moving against the effect of its elastic return to overcome and then catch onto said retaining projection further on at the end of the pivoting of the pawl, the pawl thus being immobilized in the separated position by the latch by means of said catching member, until the latch begins to pivot toward its lock unlocked position, the pivoting of the latch causing the catching member to disengage from the retaining projection.

2. Lock according to claim 1, characterized in that the wrist pin (28, 29) of the rotary element (27) and the V-shaped recess (134, 234, 334) of the driver (132, 232, 332) are arranged with respect to each other in such a way that when the wrist pin enters the recess it causes the driver to pivot through an unlocking travel which causes the pawl **(131, 231*a*, 331*a*) to separate from the latch (130, 230, 330)** until the pawl escapes the notch of the latch, then the wrist pin causes the driver to pivot through an additional travel before escaping the V-shaped recess, said additional travel making it possible to generate clearance (d) between the latch and the pawl, which clearance is maintained by the aforementioned immobilizing means at the latest until it has left its active immobilizing position.

3. Lock according to claim 2 characterized in that the catching member is an elastically deformable tab.

4. Lock according to claim 2 characterized in that the catching member is a moving retractable peg subject to the elastic force of a return spring.

5. Lock according to claim 2, characterized in that the immobilizing means (140, 141; 240, 241; 340, 341) adopts its second position of releasing the pawl **(131, 231*a*, 331*a*) as soon as the latch (130, 230, 330) turns with a view to releasing the striker (4)**, the pawl pivoting through a distance corresponding to the aforementioned clearance (d) as it passes from the first, active, position into said second position.

6. Lock according to claim 5 characterized in that the catching member is an elastically deformable tab.

7. Lock according to claim 5, characterized in that when the immobilizing means is in its second position—that of releasing the pawl **(131, 231*a*, 331*a*), the catching member (140, 240, 340) is upstream of the retaining projection (141, 241, 341) so that as the latch (130, 230, 240)** returns to the locked position, the retaining projection pushes the catching member back toward its position of rest, in the direction of the elastic return force of the pawl, which contributes to returning the pawl to the position of rest in order to lock the lock.

8. Lock according to claim 7 characterized in that the catching member is an elastically deformable tab.

9. Lock according to claim 1, characterized in that the catching member is an elastically deformable tab (140, 340).

10. Lock according to claim 9, characterized in that the elastically deformable tab (140) is in the shape of a hairpin bent into a U, one end of which is secured to the driver (132), and the other free end of which is capable of catching on the retaining projection (141) formed on the latch (130).

11. Lock according to claim 10 characterized in that the driver is a lever which, in plan view, has the shape of a boot, the aforementioned recess corresponding to the hollow there is between the sole part and the heel part of the boot, the articulation about which said lever pivots being at its opposite end to the end bearing the parts of the boot.

12. Lock according to claim 11, characterized in that the elastically deformable tab (140) is secured to the driver (132) substantially at the tip of the sole part (132*a*) of the boot.

13. Lock according to claims 1, characterized in that the catching member is a moving retractable peg (240) subject to the elastic force of a return spring (246).

14. Lock according to claim 13, characterized in that the moving peg (240) is mounted so that it can retract linearly on the latch (230), the free end of the peg being capable of catching on said retaining projection (241) formed on the driver (232).

15. Lock according to claim 14 characterized in that the driver is a lever which, in plan view, has the shape of a boot, the aforementioned recess corresponding to the hollow there is between the sole part and the heel part of the boot, the articulation about which said lever pivots being at its opposite end to the end bearing the parts of the boot.

16. Lock according to claim 15, characterized in that the retaining projection (241) is formed on the boot (232) on the opposite face to the sole (232*a*).

17. Lock according to claim 1, characterized in that the retaining projection (141, 241, 341) is extended upstream by a guide ramp (142, 242, 342) against which the catching member (140, 240, 340) bears as the pawl (131, 231*a*, 331*a*) pivots before reaching the active immobilizing position, this making it easier for the catching member to overcome the retaining projection, said guide ramp being inclined in such a way as to generate on the pawl a force which tends to make the pawl pivot in the direction of the elastic return force, as the latch (130, 230, 330) returns to its lock locked position.

18. Lock according to claim 1, characterized in that the driver (132, 232, 332) is a lever which, in plan view, has the shape of a boot, the aforementioned recess (134, 234, 334) corresponding to the hollow there is between the sole part (132*a*, 232*a*, 332*a*) and the heel part (132*b*, 232*b*, 332*b*) of the boot, the articulation about which said lever pivots being at its opposite end to the end bearing the parts of the boot.

19. Lock according to claim 18, characterized in that the rotary element (27) is driven by a motor (9) which has just one direction of rotation and bears two wrist pins (28, 29) arranged symmetrically with respect to its axis, the means of stopping the motor consisting, firstly, of that one of its wrist pins which has not, during the lock unlocking operation just performed, caused the driver (132, 232, 332) to pivot coming mechanically into abutment against the sole part of the driver and, secondly, of the cutting of the power supply to the motor, which does not occur until after the wrist pin has come mechanically into abutment against the driver.

20. Lock according to claim 19 characterized in that the pawl (131, 231*a*, 331*a*) bears against an edging (135, 235, 335) of the latch (130, 230, 330) and, when the lock reaches the locked position, the pawl coming to cooperate with a notch (136, 236, 336) in the latch under the action of its elastic return, the driver (132, 232, 332) and the pawl pivot through an angle that is large enough for the wrist pin which was in line with the sole part of the driver to come into line with the recess (134, 234, 334).

* * * * *